US005724632A

United States Patent [19]

Arahira et al.

[11] Patent Number: 5,724,632

[45] Date of Patent: Mar. 3, 1998

[54] CHARGING APPARATUS AND ELECTROPHOTOGRAPHIC APPARATUS

[75] Inventors: Fumihiro Arahira; Shuichi Aita; Tsutomu Kukimoto, all of Yokohama; Kiyoshi Mizoe, Kawasaki; Yoshifumi Hano, Inagi, all of Japan

[73] Assignee: Canon Kabushiki Kaisha, Tokyo, Japan

[21] Appl. No.: 767,802

[22] Filed: Dec. 17, 1996

[30] Foreign Application Priority Data

Dec. 18, 1995 [JP] Japan ..... 7-347539
Dec. 18, 1995 [JP] Japan ..... 7-347541

[51] Int. Cl.[6] ..... G03G 15/02

[52] U.S. Cl. ..... 399/174; 399/175; 361/225

[58] Field of Search ..... 399/168, 174–176; 361/214, 225, 230

[56] References Cited

U.S. PATENT DOCUMENTS

| | | | |
|---|---|---|---|
| 4,174,903 | 11/1979 | Snelling | 399/148 |
| 5,307,122 | 4/1994 | Ohno et al. | 399/174 |
| 5,351,109 | 9/1994 | Haneda | 399/175 |
| 5,357,323 | 10/1994 | Haneda et al. | 399/175 |
| 5,367,365 | 11/1994 | Haneda et al. | 399/174 |
| 5,381,215 | 1/1995 | Haneda et al. | 399/174 |
| 5,426,489 | 6/1995 | Haneda et al. | 399/175 |
| 5,457,522 | 10/1995 | Haneda et al. | 399/176 |
| 5,532,101 | 7/1996 | Nozawa et al. | 430/125 |
| 5,534,981 | 7/1996 | Ohno et al. | 399/252 |
| 5,579,095 | 11/1996 | Yano et al. | 399/175 |
| 5,592,264 | 1/1997 | Shigeta et al. | 399/175 |
| 5,596,394 | 1/1997 | Nishiguchi et al. | 399/175 |
| 5,606,401 | 2/1997 | Yano | 399/175 |

FOREIGN PATENT DOCUMENTS

| | | |
|---|---|---|
| 0474220 | 3/1992 | European Pat. Off. . |
| 0593245 | 4/1994 | European Pat. Off. . |
| 0660199 | 6/1995 | European Pat. Off. . |
| 0662703 | 7/1995 | European Pat. Off. . |
| 61-57958 | 3/1986 | Japan . |
| 63-149669 | 6/1988 | Japan . |
| 06-274005 | 9/1994 | Japan . |

OTHER PUBLICATIONS

Kagawa, et al., "Contact Charging Characteristics Using Conductive Roller", Japan Hardcopy 1992 Transactions, pp. 287–290 (1992).

*Primary Examiner*—Matthew S. Smith
*Attorney, Agent, or Firm*—Fitzpatrick, Cella, Harper & Scinto

[57] ABSTRACT

A charging apparatus or an electrophotographic apparatus includes an electrophotographic photosensitive member including a photosensitive layer provided on a conductive supporting member, and a charging member including magnetic particles, disposed to be in contact with the electrophotographic photosensitive member, for charging the electrophotographic photosensitive member when a voltage is applied to the charging member. The layer of the electrophotographic photosensitive member most separated from the conductive supporting member has a volume resistivity between $10^8$ Ω.cm and $10^{15}$ Ω.cm, and the magnetic particles have a hygroscopic property such that the ratio H/L of the maximum value H to the minimum value L of the amount of water contained within the particles is at least 1 and less than 4.

22 Claims, 4 Drawing Sheets

CHARGING APPARATUS AND ELECTROPHOTOGRAPHIC APPARATUS

BACKGROUND OF THE INVENTION

1. Field of the Invention

This invention relates to a charging apparatus and an electrophotographic apparatus, and more particularly, to a charging apparatus and an electrophotographic apparatus in which magnetic particles having specific properties are used.

2. Description of the Related Art

Various kinds of electrophotographic methods are known. In general, however, a photoconductive material is used, and an electrostatic latent image is formed on a photosensitive member using charging means and image exposure means. Then, the latent image is developed using a toner to provide a visible image (toner image). After transferring the toner image onto a transfer material, such as paper or the like, the toner image on the transfer material is fixed using heat, pressure of the like to provide a copy. At that time, toner particles remaining on the photosensitive member without being transferred onto the transfer material are removed from the photosensitive member in a cleaing process.

Recently, various kinds of organic photoconductive materials have been developed as photoconductive materials for electrophotographic photosensitive members. In particular, function-separation-type photosensitive members in which a charge generation layer and a charge transfer layer are laminated have been practically used in copiers, printers, facsimile apparatus and the like. Means utilizing corona discharge are used as charging means for such electrophotographic apparatuses. Such means, however, must include filters for absorbing the large amount of ozone generated during corona discharge, thereby causing, for example, an increase in the size of the apparatus or the running cost.

As a technique for solving such problems, charging methods, in which the generation of ozone is minimized by contacting a charging member in the form of a roller, a blade or the like with the surface of the photosensitive member to form a narrow space in the vicinity of the contact portion and thereby producing a discharge that can be construed by Paschen's law, have been developed. Particularly, a roller charging method in which a charging roller is used as a charging member has been preferably used from the view point of stability of charging. In this method, since charging is realized by discharge from the charging member to the member to be charged, charging starts by applying a voltage whose value equals at least a threshold voltage value.

For example, when contacting a charging roller with a photosensitive member comprising an organic photoconductive material and having a photosensitive layer with a thickness of about 25 μm, the surface potential of the photosensitive member starts to increase upon application of a voltage of at least about 640 V, and thereafter linearly increases with respect to the applied voltage. This threshold voltage will be hereinafter termed a "charge starting voltage Vth". That is, in order to obtain a surface potential Vd of the photosensitive member, a DC voltage of at least Vd+Vth is required for the charging roller.

Accordingly, as described in Japanese Patent Laid-Open Application (Kokai) No. 63-149669 (1988), in order to obtain uniform charging, a DC+AC charging method in which a voltage obtained by superimposing an AC voltage having a peak-to-peak voltage of at least 2×Vth on a DC voltage corresponding to a desired Vd is applied to a charging roller is adopted. The object of this method is to smooth the potential by the AC voltage. The potential of the charged member converges to the central value Vd of the AC voltage, and is not influenced by external disturbance, such as environment or the like.

This charging method uses the discharging phenomenon from the charging member to the charged member as the essential charging mechanism. Hence, as described above, a value equal to or greater than the surface potential of the photosensitive member is required for the voltage necessary for charging. Furthermore, the generation of vibration and noise (hereinafter termed an "AC charging sound") in the charging member and the photosensitive member due to the electric field of the AC voltage, degradation of the surface of the photosensitive member, and the like become pronounced, thereby causing new problems.

On the other hand, as disclosed in Japanese Patent Laid-Open Application (Kokai) No. 61-57958 (1985), there is an image forming method in which a photosensitive member having a conductive protective layer is charged using conductive fine particles. This publication discloses that by charging a photosensitive member having a semiconductive protective film having a resistivity of $10^7$–$10^{13}$ Ω.cm using conductive fine particles having a resistivity equal to or less than $10^{10}$ Ω.cm, it is possible to uniformly charge the photosensitive member without injecting electric charges into the photosensitive layer, and to perform excellent image reproduction. In this method, although the above-described problems, such as vibration, noise and the like, in AC charging can be prevented, the charging efficiency is inferior, and toner particles remaining after image transfer adhere to the conductive fine particles, serving as a charging member, for example, by being scraped up by the conductive fine particles, thereby causing a change in the charging characteristics.

Accordingly, charging by direct injection of electric charges into the photosensitive member has been desired.

An injection charging method, in which electric charges are injected onto trap levels present on the surface of the photosensitive member by applying a voltage to a contact charging member, such as a charging roller, a charging fiber brush, a charging magnetic brush or the like, is described, for example, in "Characteristics of contact charging using a conductive roller", Japan Hardcopy 1992 Transactions, p. 287 (in Japanese). In this method, injection charging is performed for a photosensitive member which is an insulator in the dark using a low-resistivity charging member to which a voltage is applied, under the conditions that the resistivity of the charging member is sufficiently low and a material for making the charging member conductive (such as a conductive filler or the like) is sufficiently exposed on the surface of the charging member. Accordingly, in the above-cited literature, it is described that an aluminum foil or an ion-conductive charging member whose resistivity is sufficiently low in high humidity is preferable as the charging member. According to the studies made by the inventors of the present invention et al., the resistivity of the charging member capable of performing sufficient charge injection for the photosensitive member is equal to or less than $1\times10^3$ Ω.cm, and a difference starts to occur between the applied voltage and the charging potential if the charging member having a resistivity greater than the above-described value is used, thereby causing a problem in the converging property of the charging potential.

However, if a charging member having a resistivity lower than the above-described value is actually used, an excessive leakage current flows from the injection charging member into a scratch, a pinhole or the like produced on the surface of the photosensitive member, thereby facilitating a failure in charging in the vicinity of the concerned portion, an enlargement of the pinhole, and the breakdown of the charging member due to passage of current.

In order to prevent such phenomena, the resistivity of the charging member must be at least $1\times10^4$ Ω.cm. However, the capability of charge injection into the photosensitive member of the charging member having such a resistivity is inferior because of the above-described reason, and charging cannot be performed.

In addition, the resistivity of the charging member is apt to change depending on the environment of the use. If the resistivity changes, the capability of charge injection into a member to be charged also changes, thereby causing a change in the charging characteristics. Accordingly, it is necessary to control the applied voltage, the bias voltage for development, and the like. For performing such a control, a temperature sensor, a humidity sensor, control means and the like must be provided, and the production cost thereby increases.

SUMMARY OF THE INVENTION

It is an object of the present invention to provide a charging apparatus and an electrophotographic apparatus in which changes in the charging characteristics due to a changes in the environment are small.

According to one aspect, the present invention which achieves the above-described object relates to a charging apparatus comprising an electrophotographic photosensitive member comprising a photosensitive layer provided on a conductive supporting member, and a charging member comprising magnetic particles, in contact with the electrophotographic photosensitive member, for charging the electrophotographic photosensitive member when a voltage is applied to the charging member. The layer of the electrophotographic photosensitive member which is most separated from the conductive supporting member has a volume resistivity between $10^8$ Ω.cm and $10^{15}$ Ω.cm, and the magnetic particles have a hygroscopic property such that the ratio H/L of the maximum value H to the minimum value L of the amount of water contained within the particles is at least 1 and less than 4.

According to another aspect, the present invention which achieves the above-described object relates to an electrophotographic apparatus, comprising an electrophotographic photosensitive member comprising a photosensitive layer provided on a conductive supporting member a charging member comprising magnetic particles in contact with the electrophotographic photosensitive member, for charging the electrophotographic photosensitive member when a voltage is applied to the charging member, exposure means, developing means and transfer means. The layer of the electrophotographic photosensitive member which is most separated from the conductive supporting member has a volume resistivity between $10^8$ Ω.cm and $10^{15}$ Ω.cm, and the magnetic particles have a hygroscopic property such that the ratio H/L of the maximum value H to the minimum value L of the amount of water contained within the particles is at least 1 and less than 4.

The foregoing and other objects, advantages and features of the present invention will become more apparent from the following detailed description of the preferred embodiments taken in conjunction with the accompanying drawings.

DETAILED DESCRIPTION OF THE INVENTION

Figure 1:
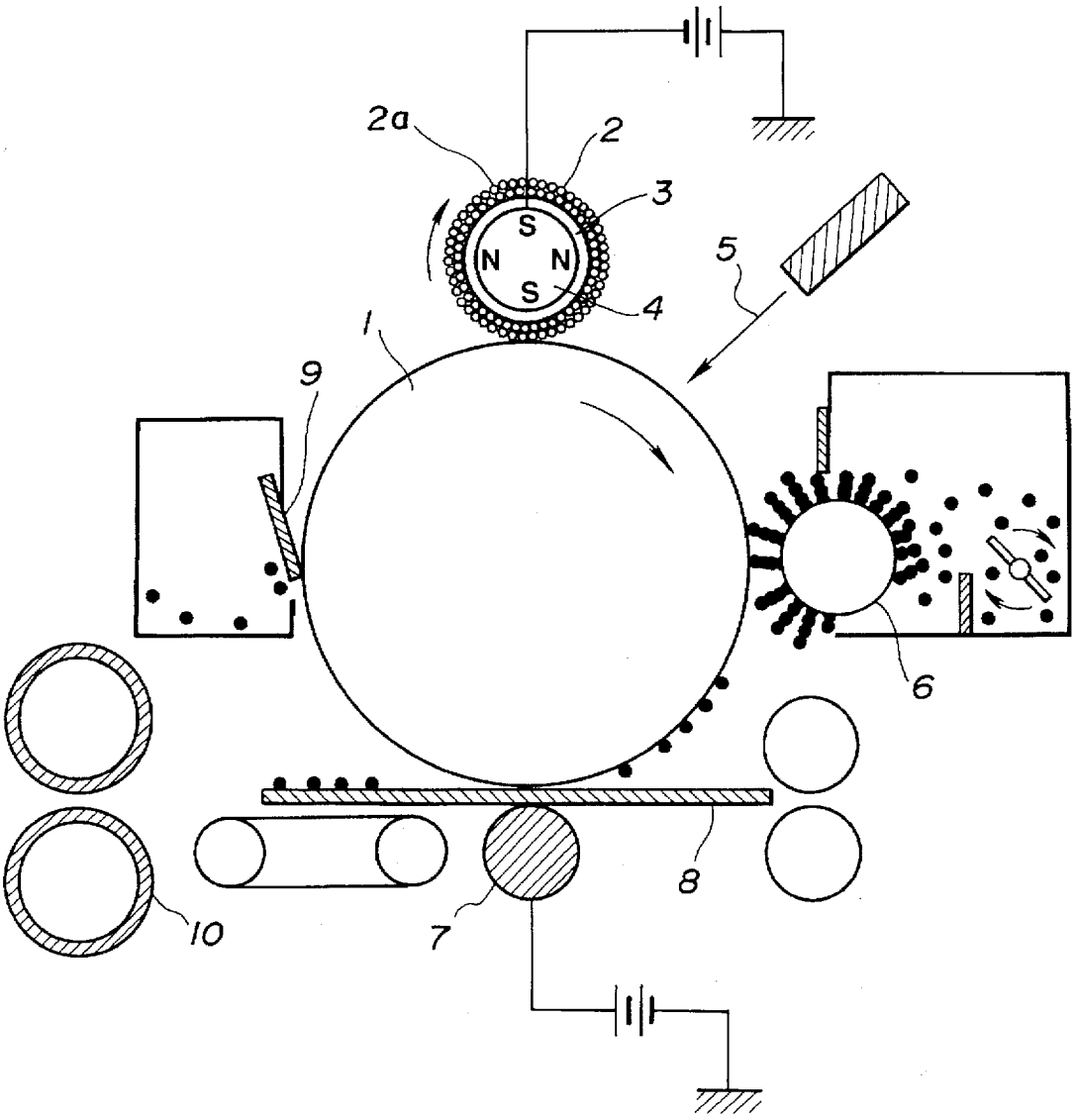
FIG. 1 is a schematic diagram illustrating the configuration of an electrophotographic apparatus according to the present invention.

A charging apparatus or an electrophotographic apparatus according to the present invention comprises an electrophotographic photosensitive member comprising a photosensitive layer provided on a conductive supporting member, and a charging member comprising magnetic particles, disposed to be in contact with the electrophotographic photosensitive member, for charging the electrophotographic photosensitive member when a voltage is applied to the charging member. The layer of the electrophotographic photosensitive member which is most separated from the conductive supporting member has a volume resistivity between $10^8$ Ω.cm and $10^{15}$ Ω.cm, and the magnetic particles have a hygroscopic property such that the ratio H/L of the maximum value H to the minimum value L of the amount of water contained within the particles is at least 1 and less than 4.

In the present invention, it is preferable that $1 \leqq H/L < 2.4$.

If the value H/L is at least 4, the volume resistivity of the magnetic particles, particularly when applying a low voltage, differs by at least 10 times, and the charging characteristics greatly differ depending on the environment.

In the present invention, the maximum value of the amount of water indicates the amount of water contained in the magnetic particles in an environment of an absolute humidity of 0.03 g $H_2O$/g dry air (corresponding to a temperature of 32° C. and a relative humidity of 85%), and the minimum value of the amount of water indicates the amount of water contained in the magnetic particles in an environment of an absolute humidity of 0.005 g $H_2O$/g dry air (corresponding to a temperature of 15° C. and a relative humidity of 10%).

In order to provide the above-described hygroscopic characteristics, it is preferable that the surfaces of the magnetic particles be covered with a compound containing hydrolytic groups, serving as hydrophilic groups, and organic groups, serving as hydrophobic groups. By covering the surfaces of the magnetic particles with such a compound, the surfaces of the magnetic particles are chemically bonded to the hydrophilic groups to form a very thin organic film. This allows reduced adsorption of water on the surfaces of the magnetic particles in an environment of high humidity. As a result, changes in the amount of water and in the resistivity of the magnetic particles depending on the environment are small, and therefore changes in the charging characteristics due to changes in the environment can be reduced.

Titanate-type coupling agents, aluminum-type coupling agents, and silane-type coupling agents are preferable as the above-described compounds containing hydrolytic groups, serving as hydrophilic groups, and organic groups, serving as hydrophobic groups. More specifically, KRTTS, KR46B, KR55, KR41B, KR38S, KR138S, KR238S, 338X, KR44 and KR9SA (titanate-type coupling agents), AL-M, FA-21, FA-23 and FC-2 (aluminum-type coupling agents) made by Ajinomoto Co., Inc., SH602, SZ602, SH6026, SZ6030, SZ6032, SH6040, SZ6050, SH6062, SZ6070, SZ6075, SH6076, SZ6079, SZ6083, SZ6300, AY43-021, PRX11, PRX19 and PRX24 (silane-type coupling agents) made by Toray-Dow Corning Kabushiki Kaisha, and the like can be used.

In order to coat one of the above-described compounds on the surfaces of the magnetic particles, a method of adding an appropriate amount of the compound to the magnetic particles and coating the compound on the surfaces of the magnetic particles by high-speed stirring while heating (a dry method), a method of dissolving the compound in a solvent, adding the magnetic particles thereto, taking out the magnetic particles after stirring, and removing the solvent by drying by heating (a wet method), a method of simultaneously adding the magnetic particles and the compound (an integral blend method), or the like is used.

Since a very thin molecular-level organic coating can be coated on the surfaces of the magnetic particles by using the above-described compounds, it is possible to reduce adsorption of water on the surfaces of the magnetic particles. As a result, a change in the resistivity of the magnetic particles depending on the environment is reduced. Since a very thin molecular-level film is formed, it is possible to maintain substantially the same charging characteristics with little change in the resistivity of the magnetic particles.

In still another method, a resin layer, particularly, a resin layer having a small critical surface tension, is formed on the surfaces of the magnetic particles by dispersing conductive particles in a binding resin.

Polyolefin, a fluororesin, a silicone resin or the like can be used as the resin having a small critical surface tension.

For example, polyvinyl fluoride, polyvinylidene fluoride, polytrifluoroethylene, polychlorotrifluoroethylene, polydichloro-difluoroethylene, polytetrafluoroethylene, polyhexafluoroethylene or the like, and a solvent-soluble copolymer obtained by copolymerization of such resin with another monomer can be used as the fluororesin.

For example, KR271, KR282, KR311, KR255 or KR155 (styrate silicone varnishes), KR211, KR212, KR216, KR213, KR217 or KR9218 (silicone varnishes for denaturation), SA-4, KR206 or KR5206 (silicone alkyd varnishes), ES1001N, ES1002T or ES1004 (silicone epoxy varnishes), KR9706 (silicone acrylic varnishes), KR5203 or KR5221 (silicone polyester varnishes) made by Shin-Etsu Silicone Kabushiki Kaisha, or SR2100, SR2101, SR2107, SR2110, SR2108, SR2109, SR2400, SR2410, SR2411, SH805, SH806A or SH840 made by Toray Silicone Kabushiki Kaisha can be used as the silicone resin.

Electron-conductive powder made of a metal, such as copper, nickel, iron, aluminum, gold, silver or the like, a metal oxide, such as iron oxide, ferrite, zinc oxide, tin oxide, antimony oxide, titanium oxide or the like, carbon black or the like can be used for the conductive particles. Lithium perchlorate, quaternary ammonium salt or the like can be used as an ion-conductive agent.

The above-described resin in which the conductive particles are dispersed is coated on the surface of the magnetic particles according to the following method. First, the binding resin is dissolved in a solvent, and the conductive particles are added thereto and dispersed to provide a solution for the surface layer. In one method, the surface layer is formed by immersing the magnetic particles in this solution and volatilizing the solvent using a spray dryer. In another method, the surface layer is gradually formed by spraying and drying the solution for the surface layer while forming a fluidized bed by putting the magnetic particles in an ordinary fluidized-bed coating apparatus.

However, when forming the resin layer, if only the resin is coated, the resistivity of the magnetic particles becomes high, thereby degrading the injectability of electric charges. Accordingly, as described above, it is necessary to include conductive particles in the resin, and therefore to provide a process of dispersing the conductive particles in the resin. It is also necessary to coat a larger amount of the resin containing the conductive particles on the magnetic particles than when coating a compound containing hydrolytic groups and organic groups. Hence, it is preferable to coat the magnetic particles with a compound containing hydrolytic groups, serving as hydrophilic groups, and organic groups, serving as hydrophobic groups, from the viewpoint of ease and cost of production.

The volume resistivity of the magnetic particles, serving as the charging member, in the present invention is preferably $10^4$ Ω.cm–$10^9$ Ω.cm in an environment of an absolute humidity of 0.005–0.03 g $H_2O$/g dry air, and more preferably, $10_4$ Ω.cm–$10^7$ Ω.cm. If the volume resistivity of the charging member is less than $10^4$ Ω.cm, the charging current concentrates onto a defect, such as a pinhole or the like, produced on the photosensitive member, thereby tending to produce breakdown due to current passage in the charging member and the photosensitive member. If the volume resistivity of the charging member exceeds $10^9$ Ω.cm, excellent charge injection is, in many cases, not performed, thereby tending to cause a failure in charging.

Figure 2:
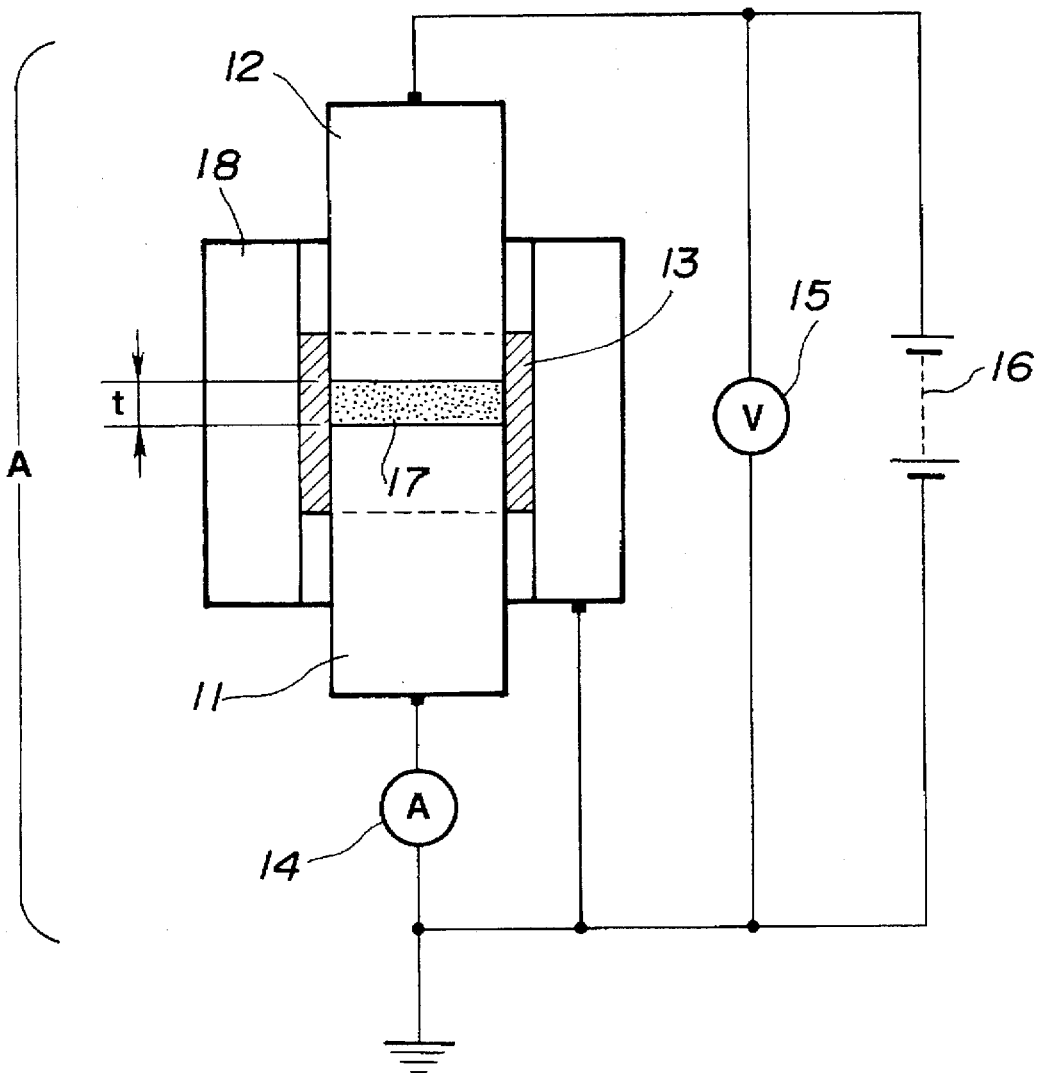
FIG. 2 is a schematic cross-sectional view illustrating the configuration of an apparatus for measuring the volume resistivity of magnetic particles in the present invention.

The volume resistivity of the magnetic particles is measured using a cell as shown in FIG. 2. That is, the magnetic particles are filled in a cell A, and electrodes 11 and 12 are disposed so as to contact the magnetic particles 17. A voltage is applied between the electrodes 11 and 12, and the volume resistivity is obtained by measuring the current flowing at that time. The measurement is performed at a temperature of 32° C. and a relative humidity of 85%, or a temperature of 15° C. and a relative humidity of 10%, the contact area between the magnetic particles and the cell A=2 $cm^2$, a thickness t of 1 mm, a load on the upper electrode of 2 kg, and an applied voltage of 10–100 V. In FIG. 2, there are shown the main electrode 11, the upper electrode 12, an insulator 13, an ammeter 14, a voltmeter 15, a constant-voltage device 16, magnetic particles 17, and a guide ring 18.

The average particle size of the magnetic particles is preferably 5–200 μm. If the size is less than 5 μm, the magnetic brush tends to adhere to the photosensitive member. If the size is greater than 200 μm, it is difficult to provide a high density for the ear of the magnetic brush formed on the sleeve, thereby tending to degrade the capability of injection charging into the photosensitive member. More preferably, the size is 10–100 μm, and still more preferably, the size is 10–50 μm.

The average particle size may be obtained by measuring the magnetic particles by logarithmically dividing the range of 0.05–200 μm into 32 regions using a laser-diffraction-type particle-size-distribution measuring apparatus HEROS (made by NEC Corporation), and making a 50% average particle size the average particle size.

The specific surface area of the magnetic particles is preferably equal to or less than 0.5 $m^2$/g, and more preferably, equal to or less than 0.16 $m^2$/g. If the specific surface area of the magnetic particles exceeds 0.5 $m^2$/g, the amount of water adsorbed on the surfaces of the magnetic particles increases in an environment of high humidity and decreases in an environment of low humidity. Hence, the amount of water greatly changes depending on the environment, and the resistivity of the magnetic particles also greatly changes, thereby causing a pronounced change in the charging characteristics due to the environment.

In the present invention, the specific surface area may be measured by using a specific surface area meter (trade name: Autosorb-1, manufactured by Quantachrome Co.) according to the BET multipoints method with $N_2$ gas.

In the present invention, since the magnetic brush (charging member) formed by magnetically providing an ear of the magnetic particles is brought in contact with the photosensitive member, an alloy or a compound containing at least one ferroelectric element selected from iron, nickel, cobalt and the like, a ferrite whose resistivity is adjusted by oxidation processing, reduction processing or the like, such as a ferrite having an adjusted composition or a Zn—Cu ferrite subjected to hydrogen-reduction processing, or the like is used for the magnetic particles. In order to arrange the resistivity of the ferrite within the above-described range, the composition ratio of the metal may be adjusted. In general, the resistivity decreases as the composition ratio of a metal other than bivalent iron increases, thereby tending to cause an abrupt decrease in the resistivity.

The gap between the holding member (sleeve) for holding the magnetic brush and the photosensitive member is preferably within the range of 0.2–2 mm. If the gap is less than 0.2 mm, the magnetic particles pass through the gap with difficulty, so that the magnetic particles are not smoothly conveyed on the holding member, thereby tending to cause a failure in charging, an excess of magnetic particles remaining in the nip portion, and adherence of the magnetic particles to the photosensitive member. A gap exceeding 2 mm is not preferable, because it is difficult to form a wide nip between the photosensitive member and the magnetic particles. More preferably, the gap is 0.2–1 mm, and still more preferably, 0.3–0.7 mm.

In the present invention, from the viewpoint of further improvement in the charging capability and prevention of current leakage through pinholes, the volume resistivity measured according to a method for measuring the dynamic resistivity of the charging member is preferably $10^4$ .cm–$10^{10}$ Ω.cm.

The dynamic resistivity is measured in the following manner. If the voltage applied to the charging member is represented by V (V), the potential on the photosensitive member when entering a nip portion between the photosensitive member and the charging member (at the upstream side in the moving direction of the photosensitive member as seen from the nip portion) is represented by $V_D$ (V), the distance between a portion of the charging member where the voltage is applied and the photosensitive member is represented by d (cm), and the greater value of the absolute values of $(V-V_D)/d$ and V/d is represented by an electric field E (V/cm), and the volume resistivity within the range of the applied electric field of 20-E (V/cm) is measured as follows.

Figure 3:
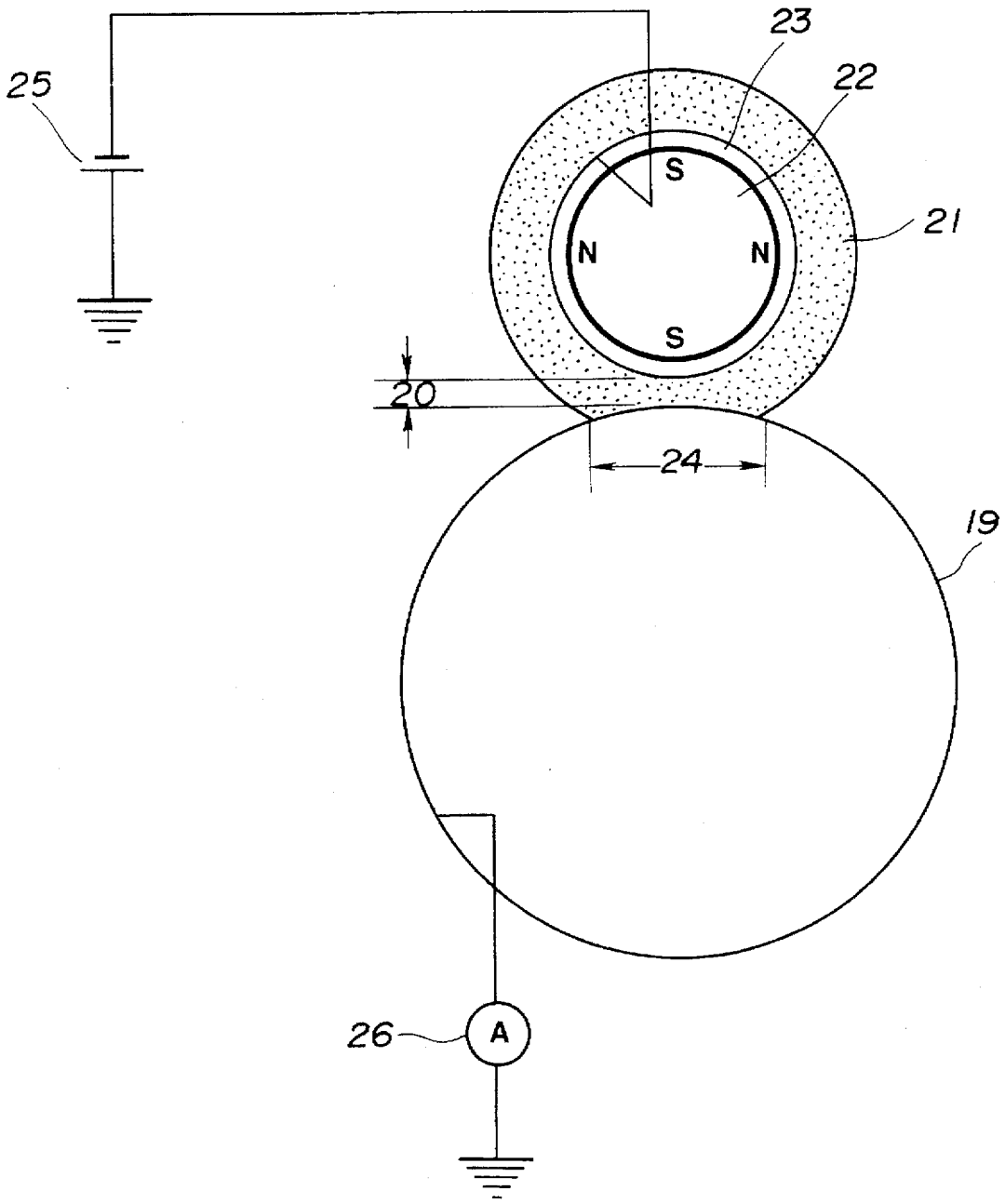
FIG. 3 is a schematic diagram illustrating the configuration of a dynamic-resistivity measuring apparatus for measuring the volume resistivity of a charging member in the present invention.

In the present invention, the volume resistivity may be measured using an apparatus as shown in FIG. 3. That is, a charging member 21 is mounted on a sleeve 23 incorporating a magnet 22, serving as a holding member of the charging member 21 and having a gap 20 of 0.5 mm with an aluminum drum 19, serving as a conductive supporting member, so as to provide a nip 24 of 5 mm. The charging member 21 and the aluminum drum 19 are rotated at the rotation speed in the direct on of rotation when performing actual image formation, and a DC voltage is applied from a power supply 25 to the charging member 21. The resistance is obtained by measuring the current flowing in this system using an ammeter 26, and the volume resistivity is calculated from the gap 20, the nip 24, and the width of contact between the charging member 21 and the aluminum drum 19.

The resistivity of the charging member generally changes as the electric field applied to the charging member changes, i.e., the resistivity is low when the applied electric field is high, and the resistivity is high when the applied electric field is low. Hence, the resistivity depends on the applied electric field.

In the case in which charging is performed by injecting electric charges into the photosensitive member, when the surface of the photosensitive member to be charged enters the nip portion between the photosensitive member and the charging member (at the upstream side as seen from the charging member), the difference between the charging potential of the photosensitive member before entering the nip portion and the voltage applied to the charging member is large, and therefore the voltage applied to the charging member is high. While the photosensitive member passes through the nip portion, charges are injected into the photosensitive member, and charging is thereby gradually performed within the nip portion. Thus, the potential on the photosensitive member gradually approaches the voltage applied to the charging member to reduce the difference between the voltage applied to the charging member and the potential on the photosensitive member. As a result, the electric field applied to the charging member decreases. That is, in the process of charging the photosensitive member, the electric field applied to the charging member differs between the upstream side and the downstream side, i.e., he electric field is high at the upstream side and low at the downstream side.

Accordingly, when a process of removing charges, such as pre-exposure or the like, is performed before performing the charging process, the potential on the photosensitive member when entering the nip portion provided with the charging member is substantially zero. Hence, the applied voltage at the upstream side is determined substantially by the voltage applied to the charging member. On the other hand, when the above-described process of removing charges is not performed, the applied voltage is determined by the voltages and polarities during charging and image transfer, i.e., by the potential on the photosensitive member after image transfer and the voltage applied to the charging member.

That is, when charging is performed by injecting charges into the photosensitive member, even if the volume resistivity of the charging member is within the range of $10^4$ Ω.cm–$10^{10}$ Ω.cm at a certain applied voltage, if, for example, the resistivity exceeds $10^{10}$ Ω.cm within the range equal to or less than an applied electric field of 0.3×V/d (V/cm) formed by an applied voltage equal to 30% of the voltage applied to the charging member, charging by injection is greatly degraded at the downstream side of the nip portion of the charging member. Hence, although charging is excellent until the potential on the photosensitive member reaches 70% of the applied voltage, the charge injection capability is degraded after the potential has reached 70% or the applied voltage, so that the photosensitive member cannot be charged to a desired potential and a failure in charging occurs. That is, the resistivity when a low electric field is applied greatly influences the capability of charge injection into the photosensitive member, i.e., the charging capability of the photosensitive member.

Accordingly, the volume resistivity of the charging member measured by the dynamic resistivity measuring method is preferably equal to or less than $10^{10}$ Ω.cm, because substantially the same potential as the applied voltage can be obtained on the photosensitive member.

On the other hand, if the volume resistivity of the charging member is less than $10^4$ Ω.cm at the applied electric field formed by the voltage applied to the charging member, an excessive leakage current flows from the charging member into a scratch, a pinhole or the like present on the surface of the photosensitive member, thereby tending to cause a failure in charging at the surrounding portion, the enlargement of the pinhole, or breakdown due to current passage in the charging member. When the conductive layer (conductive supporting member) of the photosensitive member is exposed at the portion where the scratch, the pinhole or the like is present, the maximum electric field applied to the charging member is determined by the voltage applied to the charging member. That is, even if the volume resistivity of the charging member is at least $10^4$ Ω.cm at a certain applied electric field, there results, in some cases, a failure in charging, or inferior resistance against voltage breakdown.

As the nip width between the charging member and the photosensitive member increases, the contact area and the contact time between the charging member and the photosensitive member increase. Hence, charge injection into the surface of the photosensitive member is excellently performed, and charging is excellently performed. In order to obtain a sufficient charge injection capability even if the nip width is reduced, the ratio R1/R2 of the maximum value R1 to the minimum value R2 of the volume resistivity of the charging member is preferably equal to or less than 1000 within the above-described range of the applied electric field. This is because, if the resistivity abruptly changes within the nip, the capability of charge injection into the photosensitive member cannot follow the change, and in some cases, before the photosensitive member passes through the nip portion, sufficient charging is not performed.

By making the amount of water contained in the magnetic particles in an environment of absolute humidity of 0.005–0.03 g $H_2O$/g dry air represented by the amount of water contained in 1 g of dry air to be equal to or less than 0.1 weight %, a decrease in the resistivity at a high electric field can be prevented. If the amount of water is more than 0.1 weight %, the resistivity at a high applied electric field becomes equal to or less than $10^4$ Ω.cm. Hence, when a pinhole is produced in the surface of the photosensitive member, a leakage image due to concentration of current on that point cannot be prevented.

In the present invention, in order to satisfy the conditions of the provision of a sufficient charging capability and the prevention of the flow of an image, a photosensitive member having a charge injection layer with a volume resistivity within the range of $1\times10^8$Ω.cm and $1\times10^{15}$ Ω.cm at a portion most separated from the supporting member preferably is used. From the viewpoint of prevention of flow of an image, and the like, the volume resistivity is more preferably within the range of $1\times10^{11}$ Ω.cm–$1\times10^{14}$ Ω.cm, and in consideration of changes in the volume resistivity depending on the environment and the like, the volume resistivity is still more preferably within the range of $1\times10^{12}$ Ω.cm –$1\times10^{14}$ Ω.cm. If the volume resistivity is less than $1\times10^8$ Ω.cm, the flow of an image occurs because charges are not held in the direction of the surface in a high-humidity environment. If the volume resistivity exceeds $1\times10^{15}$ Ω.cm, charges cannot be sufficiently injected from the charging member, thereby producing a failure in charging. Such a functional layer has the role of holding charges injected from the charging member and conducting the injected charges to the base of the photosensitive member during exposure, thereby reducing the remaining potential.

By using the charging member and the photosensitive member of the present invention, it is possible to provide a small charging-start voltage Vth, and to make the charging potential of the photosensitive member to be at least about 90% of the voltage applied to the charging member. For example, when a DC voltage having an absolute value of 100–2000 V is applied to the charging member of the invention, it is possible to make the charging potential of the electrophotographic photosensitive member having the surface layer according to the present invention be at least 80% of the applied voltage, and further be at least 90% of the applied voltage. On the other hand, the charging potential of the conventional photosensitive member obtained by performing charging utilizing discharge is substantially zero when the applied voltage is equal to or less than 640 V, and has only a value obtained by subtracting 640 V from the applied voltage when the applied voltage exceeds 640 V.

A layer which allows efficient charge injection and holds injected charges as in the present invention is termed a "charge injection layer".

The charge injection layer is formed on a polyethylene terephthalate (PET) film having a Pt film deposited in a vacuum on its surface, and the volume resistivity of the charge inject on layer is measured by applying a voltage of 100 V in an environment of 23° C. and 65% relative humidity using a volume-resistivity measuring apparatus (4140B pAMATER made by Hewlett-Packard Corporation).

The charge injection layer comprises an inorganic layer, comprising a metallic film deposited in a vacuum, or the like, and a conductive powder/resin dispersion layer obtained by dispersing conductive fine particles in a binding resin. The deposited film is formed by deposition in a vacuum, and the conductive powder/resin dispersion film is formed by performing coating by a dipping coating method, a spray coating method, a roll coating method or a beam coating method. The conductive powder/resin dispersion film may also be formed by mixing or copolymerizing a transparent ion-conductive resin in an insulating binder, or by only a medium-resistance photoconductive resin. In the case of the conductive powder/resin dispersion film, the amount of addition of conductive fine particles is preferably 2–250 weight %, and more preferably, 2–190 weight % relative to the binding resin. If the amount is less than 2 weight %, it is difficult to obtain the desired volume resistivity. If the amount exceeds 250 weight %, the strength of the film decreases, and the charge injection layer is apt to be scraped off, thereby shortening the life of the photosensitive member, reducing the resistance, and tending to produce a failure in the obtained image due to the flow of the potential of the latent image.

The binding resin of the charge injection layer can be the same as that used for the lower resin layer. In this case, however, since there is the possibility that the coated surface of the charge transfer layer may be disturbed when the charge injection layer is applied, the coating method must be carefully selected.

In the present invention, the charge injection layer preferably contains lubricant particles, in order to reduce the friction between the photosensitive member and the charging member, thereby enlarging the charging nip and improving the charging characteristics. It is preferable to use a fluorine-type resin, a silicone-type resin or a polyolefin-type resin having a low critical surface tension for the lubricant particles. More preferably, a tetrafluoroethylene (PTFE) resin is used. In this case, the amount of addition of the lubricant particles is preferably 2–50 weight %, and more preferably, 5–40 weight % relative to the binding resin. If the amount of addition of the lubricant particles is less than 2 weight %, improvement in the charging characteristics is insufficient because the amount of the lubricant particles is insufficient. If the amount of addition of the lubricant particles exceeds 50 weight %, the resolution of the obtained image and the sensitivity of the photosensitive member are, in some cases, greatly degraded.

In the present invention, the thickness of the charge injection layer is preferably 0.1–10 μm, and more preferably, 1–7 μm.

The configurations, materials, manufacturing methods and the like of the members used in the present invention will now be illustrated.

EXAMPLE 1 OF MANUFACTURE OF PHOTOSENSITIVE MEMBERS

The photosensitive member comprises an organic photoconductive material (hereinafter termed an "OPC photosensitive member"), and includes five functional layers formed on a cylinder made of aluminum having a diameter of 30 mm.

The first layer is a conductive layer which comprises a conductive-particle dispersing resin layer having a thickness of about 20 μm provided in order to smooth defects and the like in the aluminum cylinder and to prevent the occurrence of a moire pattern due to the reflection of laser exposure.

The second layer is a layer for preventing injection of positive charges (an undercoating layer) and has the role of preventing positive charges injected from the aluminum supporting member from cancelling negative charges charged on the surface of the photosensitive member, and comprises a medium-resistance layer having a thickness of about 1 μm whose resistivity is adjusted to about $10^6$ Ω.cm using a 6-66-610-12-nylon resin and a methoxymethylated nylon.

The third layer is a charge generation layer and has a thickness of about 0.3 μm obtained by dispersing a diazo-type pigment in a resin. This layer generates a pair of positive and negative charges upon reception of laser exposure.

The fourth layer is a charge transfer layer having a thickness of about 25 μm obtained by dispersing hydrazone in a polycarbonate resin, and operates as a p-type semiconductor. Accordingly, negative charges charged on the surface of the photosensitive member cannot move through this layer, and only positive charges generated in the charge generation layer can be transferred through this layer to the surface of the photosensitive member.

The fifth layer is a charge injection layer, obtained by dispersing $SnO_2$ ultrafine particles, and tetrafluoroethylene-resin particles having a size of about 0.25 μm for increasing the contact time between the contact charging member and the photosensitive member in order to perform uniform charging in a photo-curing acrylic resin. More specifically, $SnO_2$ particles having a size of about 0.03 μm whose resistivity was reduced by being doped with antimony, tetrafluoroethylene-resin particles and a dispersing agent were dispersed with a weight % relative to the resin of 100%, 20% and 1.2%, respectively. The coating liquid thus prepared was coated to a thickness of about 2.5 μm according to a spray coating method to obtain the charge injection layer.

According to the above-described configuration, the volume resistivity of the surface layer of the photosensitive member was reduced to $2\times10^{13}$ Ω.cm compared with $1\times10^{15}$ Ω.cm in the case of using only a charge transfer layer.

EXAMPLE 2 OF MANUFACTURE OF PHOTOSENSITIVE MEMBERS

Photosensitive members were manufactured in the same manner as in Example 1 of manufacture of photosensitive members, except that $SnO_2$ particles having a size of about 0.03 μm whose resistivity was reduced by being doped with antimony were dispersed with a weight % of 167 relative to the resin. The volume resistivity of the surface of the photosensitive member was thereby reduced to $5\times10^{12}$ Ω.cm.

EXAMPLE 3 OF MANUFACTURE OF PHOTOSENSITIVE MEMBERS

Photosensitive members were manufactured in the same manner as in Example 1 of manufacture of photosensitive members, except that $SnO_2$ particles having a size of about 0.03 μm whose resistivity was reduced by being doped with antimony were dispersed with a weight % of 300 relative to the resin. The volume resistivity of the surface of the photosensitive member was thereby reduced to $2\times10^7$ Ω.cm.

EXAMPLE 1 OF MANUFACTURE OF CHARGING MEMBERS

By adding Zn-Cu ferrite having an average size of 25 μm and a specific surface area of 0.12 $m^2/g$ to a solution obtained by dissolving a titanate-type coupling agent KR TTS (made by Ajinomoto Co., Inc.) with a weight part of 0.05 relative to 100 weight part of the magnetic particles in a methyl-ethyl-ketone solvent, and stirring the resultant solution, an organic coating was formed on the surfaces of the magnetic particles. The solvent was removed by heating and stirring the solution. The specific surface area of the obtained magnetic particles was measured. The measured value was substantially the same as the specific surface area of the original particles.

EXAMPLE 2 OF MANUFACTURE OF CHARGING MEMBERS

The magnetic particles were processed in the same manner as in Example 1 of manufacture of charging members, except that an aluminum-type coupling agent AL-M (made by Ajinomoto Co., Ltd.) was used as a compound for covering the surfaces of the Zn-Cu ferrite magnetic particles. The specific surface area of the obtained magnetic particles was measured. The measured value was substantially the same as the specific surface area of the original particles.

EXAMPLE 3 OF MANUFACTURE OF CHARGING MEMBERS

The magnetic particles were processed in the same manner as in Example 2 of manufacture of charging members, except that the amount of the compound for covering the surfaces of the Zn-Cu-ferrite magnetic particles was 0.5 weight part. The specific surface area of the obtained magnetic particles was measured. The measured value was substantially the same as the specific surface area of the original particles.

EXAMPLE 4 OF MANUFACTURE OF CHARGING MEMBERS

The magnetic particles were processed in the same manner as in Example 1 of manufacture of charging members, except that the magnetic particles were added to a solution obtained by dissolving 0.025 weight part of KR TTS and 0.025 weight part of AL-M in the solvent. The specific surface area of the obtained magnetic particles was measured. The measured value was substantially the same as the specific surface area of the original particles.

EXAMPLE 5 OF MANUFACTURE OF CHARGING MEMBERS

The magnetic particles were processed in the same manner as in Example 1 of manufacture of charging members, except that the magnetic particles were added to a conductive xylene solution obtained by dispersing carbon black in a thermosetting silicone resin using a paint shaker using glass beads (2 weight part of silicone resin and 0.02 weight part of carbon black relative to 100 weight part of magnetic particles). The specific surface area of the obtained magnetic particles was measured. The measured value was 0.1 $m^2/g$.

EXAMPLE 6 OF MANUFACTURE OF CHARGING MEMBERS

The Zn-Cu ferrite not subjected to surface coating processing used in Example 1 of manufacture of charging members was used for the magnetic particles.

EXAMPLE 7 OF MANUFACTURE OF CHARGING MEMBERS

Zn-Cu Ferrite particles, having an average size of 26 μm and a specific surface area, of 0.06 $m^2/g$, not subjected to surface coating processing were used as the magnetic particles.

EXAMPLE 8 OF MANUFACTURE OF CHARGING MEMBERS

Zn-Cu ferrite particles, having an average size of 50 μm and a specific surface area of 0.24 $m^2/g$, not subjected to surface coating processing were used as the magnetic particles.

EXAMPLE 9 OF MANUFACTURE OF CHARGING MEMBERS

Zn-Cu ferrite particles, having an average size of 6 μm and a specific surface area of 0.77 $m^2/g$, not subjected to surface coating processing were used as the magnetic particles.

EXAMPLE 10 OF MANUFACTURE OF CHARGING MEMBERS

A 15% N-methoxymethylated nylon (product name: Tresin made by Teikoku Kagaku Kabushiki Kaisha) solution dissolved in a mixed solvent of methyl ethyl ketone and methanol was coated on the Zn-Cu ferrite magnetic particles used in Example 1 of manufacture of charging members using a fluid-bed-type coater (Spirocoater made by Okada Seiko Kabushiki Kaisha). The specific surface area of the obtained magnetic particles was measured. The measured value was substantially the same as the specific surface area of the original particles.

Embodiment 1

A description will now be provided of how charging is performed using the photosensitive member and the charging member described above.

In the present invention, charges are injected into the surface of a photosensitive member having a medium-range surface resistivity using a contact charging member having a medium-range resistivity. In the present embodiment, charging is performed by providing conductive particles within a charge injection layer with charges, instead of injecting charges into trap levels present in the material of the surface of the photosensitive member.

More specifically, the charging member supplies charges for fine capacitors, the aluminum cylinder and conductive particles within the charge injection layer. The aluminum cylinder and conductive particles both serve as electrodes. At that time, the respective conductive particles are electrically independent of one another, and each particle serves as a fine floating electrode. Accordingly, although the surface of the photosensitive member macroscopically seems to be uniformly charged, actually, a large number of fine charged $SnO_2$ particles cover the surface of the photosensitive member. As a result, it is possible to hold an electrostatic latent image even if image exposure is performed using a laser because the $SnO_2$ particles are electrically independent.

Next, a description will be provided of an electrophotographic printer used in the present embodiment with reference to FIG. 1. In FIG. 1, the process speed of the printer is 100 mm/sec. The photosensitive member manufactured in Example 1 of manufacture of photosensitive members is used as a photosensitive member 1. A charging member 2 comprises magnetic particles 2*a* manufactured in Example 1 of manufacture of charging members. There are also shown a conductive sleeve 3 made of aluminum, whose nonmagnetic surface is subjected to blast processing, for providing an ear of the magnetic particles 2*a* to be used as a magnetic brush, and a magnet roll 4 incorporated within the conductive sleeve 3. The gap between the magnetic-particle holding sleeve 3 and the photosensitive member 1 is about 500 μm. The magnetic particles 2*a* are coated on the sleeve 3 so as to form a charging nip having a width of about 5 mm with the photosensitive member 1. The magnet roll 4 is fixed, and the sleeve 3 is rotated at the same speed as the circumferential speed of the surface of the photosensitive member 1 in a reverse direction, so that the photosensitive member 1 and the magnetic brush 2*a* uniformly contact each other. When no difference is provided between the circumferential speeds of the magnetic brush 2*a* and the photosensitive member 1, since the magnetic brush 2*a* itself does not have a physical restoring force, it is often difficult to secure the nip of the magnetic brush 2*a* when the magnetic brush 2*a* is pushed back due to deflection, eccentricity or the like of the photosensitive member 1, thereby causing a failure in charging. Accordingly, since it is preferred to always provide a new surface of the magnetic brush 2*a*, in the present embodiment, charging is performed using a charging device rotating at a speed equal to twice the same speed as the photosensitive member 1, in a reverse direction.

The surface potential of the photosensitive member of the above-described apparatus was measured, and the volume resistivity and the amount of water of the magnetic particles constituting the charging member were measured in two kinds of environments, i.e., 32° C./85% relative humidity (hereinafter termed "H/H environment") and 15° C./10% relative humidity (hereinafter termed "L/L environment"), and were evaluated according to the following evaluation items. The results are shown in Table 1.

Evaluation 1

The magnetic particles constituting the charging member were left in the two environments for one week. The amount of water contained in the magnetic particles in each environment was measured using a Karl-Fischer apparatus (AQ-6, SE-24 made by Hiranuma Sangyo Kabushiki Kaisha), and the ratio or the amount of water in the H/H environment to the amount of water in the L/L environment was obtained.

Evaluation 2

The magnetic particles constituting the charging member were left in the two environments for one week. The volume resistivity in each environment was measured, and the ratio of the resistivity in the L/L environment to the resistivity in the H/H environment was obtained. In consideration of the low applied electric field which seems to have a greater effect on the charging capability, the resistivity was measured at two voltages, i.e., 10 V and 100 V. The resistivity was measured according to the above-described method shown in FIG. 2.

Evaluation 3

A DC voltage of −700 V was applied to the charging member, and the rise of the surface potential of the photosensitive member initially at 0 V (the potential at the first, revolution of the photosensitive member) was measured in the two environments, and the difference between the surface potentials in the two environments was obtained.

Embodiment 2

The same processing as in Embodiment 1 was performed, except that the magnetic particles constituting the charging member were replaced by the magnetic particles manufactured in Example 2 of manufacture of charging members, and evaluation was performed.

Embodiment 3

The same processing as in Embodiment 1 was performed, except that the magnetic particles constituting the charging member were replaced by the magnetic particles manufactured in Example 3 of manufacture of charging members, and evaluation was performed.

Embodiment 4

The same processing as in Embodiment 1 was performed, except that the magnetic particles constituting the charging member were replaced by the magnetic particles manufactured in Example 4 of manufacture of charging members, and evaluation was performed.

Embodiment 5

The same processing as in Embodiment 1 was performed, except that the magnetic particles constituting the charging member were replaced by the magnetic particles manufactured in Example 5 of manufacture of charging members, and evaluation was performed.

Embodiment 6

The same processing as in Embodiment 1 was performed, except that the magnetic particles constituting the charging member were replaced by the magnetic particles manufactured in Example 6 of manufacture of charging members, and evaluation was performed.

Embodiment 7

The same processing as in Embodiment 1 was performed, except that the magnetic particles constituting the charging member were replaced by the magnetic particles manufactured in Example 7 of manufacture of charging members, and evaluation was performed.

Embodiment 8

The same processing as in Embodiment 1 was performed, except that the magnetic particles constituting the charging member were replaced by the magnetic particles manufactured in Example 8 of manufacture of charging members, and evaluation was performed.

Embodiment 9

The same processing as in Embodiment 1 was performed, except that the magnetic particles constituting the charging member were replaced by the magnetic particles manufactured in Example 6 of manufacture of charging members, and the photosensitive member was replaced by the photosensitive member manufactured in Example 2 of manufacture of photosensitive members, and evaluation was performed.

Comparative Embodiment 1

The same processing as in Embodiment 1 was performed, except, that the magnetic particles constituting the charging member were replaced by the magnetic particles manufactured in Example 9 of manufacture of charging members, and evaluation was performed.

Comparative Embodiment 2

The same processing as in Embodiment 1 was performed, except that the magnetic particles constituting the charging member were replaced by the magnetic particles manufactured in Example 10 of manufacture of charging members, and evaluation was performed. In the H/H environment, the magnetic particles used could not prevent the generation of a leakage image when a scratch was present, on the photosensitive member.

Comparative Embodiment 3

The same processing as in Embodiment 1 was performed, except that the magnetic particles constituting the charging member were replaced by the magnetic particles manufactured in Example 4 of manufacture of charging members, and the photosensitive member was replaced by the photosensitive member manufactured in Example 3 of manufacture of photosensitive members, and evaluation was performed. However, since the potential of the latent image on the photosensitive member flows, exact measurement and evaluation could not be performed.

TABLE 1

| | Example of manufacture | | Evaluation items (Evaluation No.) | | | |
|---|---|---|---|---|---|---|
| | Charging member | Photo-sensitive member | 1 | 2 10 V | 2 100 V | 3 |
| Embodiment 1 | 1 | 1 | 1.8 | 1.6 | 1.3 | 30 |
| Embodiment 2 | 2 | 1 | 2.0 | 2 | 1.5 | 35 |
| Embodiment 3 | 3 | 1 | 1.7 | 1.4 | 1.3 | 25 |
| Embodiment 4 | 4 | 1 | 1.2 | 1.25 | 1.2 | 20 |
| Embodiment 5 | 5 | 1 | 1.9 | 1.5 | 1.2 | 30 |
| Embodiment 6 | 6 | 1 | 2.2 | 3 | 2.4 | 40 |
| Embodiment 7 | 7 | 1 | 2.0 | 2.5 | 2 | 30 |
| Embodiment 8 | 8 | 1 | 2.6 | 3 | 2 | 55 |
| Embodiment 9 | 6 | 2 | 2.2 | 3 | 2.4 | 20 |
| Comparative Embodiment 1 | 9 | 1 | 4.1 | 40 | 20 | 90 |
| Comparative Embodiment 2 | 10 | 1 | 5.2 | 60 | 30 | 170 |
| Comparative Embodiment 3 | 4 | 3 | 1.2 | 1.25 | 1.2 | NA |

It can be understood from Table 1 that, when a change in the amount of water contained in the magnetic particles constituting the charging member in the two environments is small, the difference in the surface potential on the photosensitive member is also small, so that excellent images can be obtained under the same process conditions irrespective of environment. It can be also understood that coating of a compound containing hydrolytic groups, serving as hydrophilic groups, and organic groups, serving as hydrophobic groups, on the surface of the magnetic particles is particularly effective for reducing the change in the amount of water.

Example or manufacture of toner

| | |
|---|---|
| Styrene acrylic resin | 100 weight part |
| Metallic complex of azo dye | 2 weight part |
| Carbon black | 6 weight part |
| Low-molecular-weight propylene-ethylene copolymer | 4 weight part |

The above-described materials were subjected to dry blending, and kneaded using a biaxial kneading extruder set at 130° C. The obtained kneaded substance was cooled, pulverized using an air crusher, and classified using a multi-division classifier to obtain toner particles having an average size of 5.2 μm with an adjusted particle distribution. 2.0 weight % of hydrophobic colloidal silica fine particles were added to the above-described particles to obtain final toner particles.

EXAMPLE 4 OF MANUFACTURE OF PHOTOSENSITIVE MEMBERS

Photosensitive members were formed in the same manner as in Example 1 of manufacture of photosensitive members, except that 167 weight % of $SnO_2$ particles were used.

The volume resistivity of the surface layer of the photosensitive member was thereby reduced to $5\times10^{12}$ Ω.cm compared with $1\times10^{15}$ Ω.cm when only the charge transfer layer was used.

EXAMPLE 5 OF MANUFACTURE OF PHOTOSENSITIVE MEMBERS

Photosensitive members were formed in the same manner as in Example 4 of manufacture of photosensitive members, except that the tetrafluoroethylene-resin particles and the dispersing agent were not added. The volume resistivity of the surface layer of the photosensitive member was $2\times10^{12}$Ω.cm.

EXAMPLE 6 OF MANUFACTURE OF PHOTOSENSITIVE MEMBERS

Photosensitive members were formed in the same manner as in Example 4 of manufacture of photosensitive members, except that a substance obtained by dispersing $SnO_2$ particles having a size of about 0.03 μm, whose resistivity was reduced by doping with antimony, was added at 300 weight relative to the resin. The volume resistivity of the surface layer of the photosensitive member was thereby reduced to $2\times10^{7}$ Ω.cm.

EXAMPLE 7 OF MANUFACTURE OF PHOTOSENSITIVE MEMBERS

A blocking layer, a photoconductive layer and a surface layer were sequentially formed on an aluminum cylinder subjected to mirror processing using glow discharge.

First, the pressure of the reaction chamber was reduced to about $7.5\times10^{-3}$ Pa. Then, $SiH_4$, $B_2H_6$, NO and $H_2$ gases were introduced into and evacuated from the reaction chamber to provide an internal pressure of about 30 Pa while maintaining the aluminum cylinder at 250° C., and glow discharge was generated to form a blocking layer having a thickness of 5 μm.

Then, a photoconductive layer having a thickness of 20 μm was formed in the same manner as when forming the blocking layer, using $SiH_4$ and $H_2$ gases at an internal pressure of 50 Pa. Then, a surface layer, comprising Si and C, having a thickness of 0.5 μm was formed by glow discharge at an internal pressure of 55 Pa using $SiH_4$, $CH_4$ and $H_2$ gases. Thus, an amorphous-silicon photosensitive member was formed.

EXAMPLE 11 OF MANUFACTURE OF CHARGING MEMBERS

Figure 4:
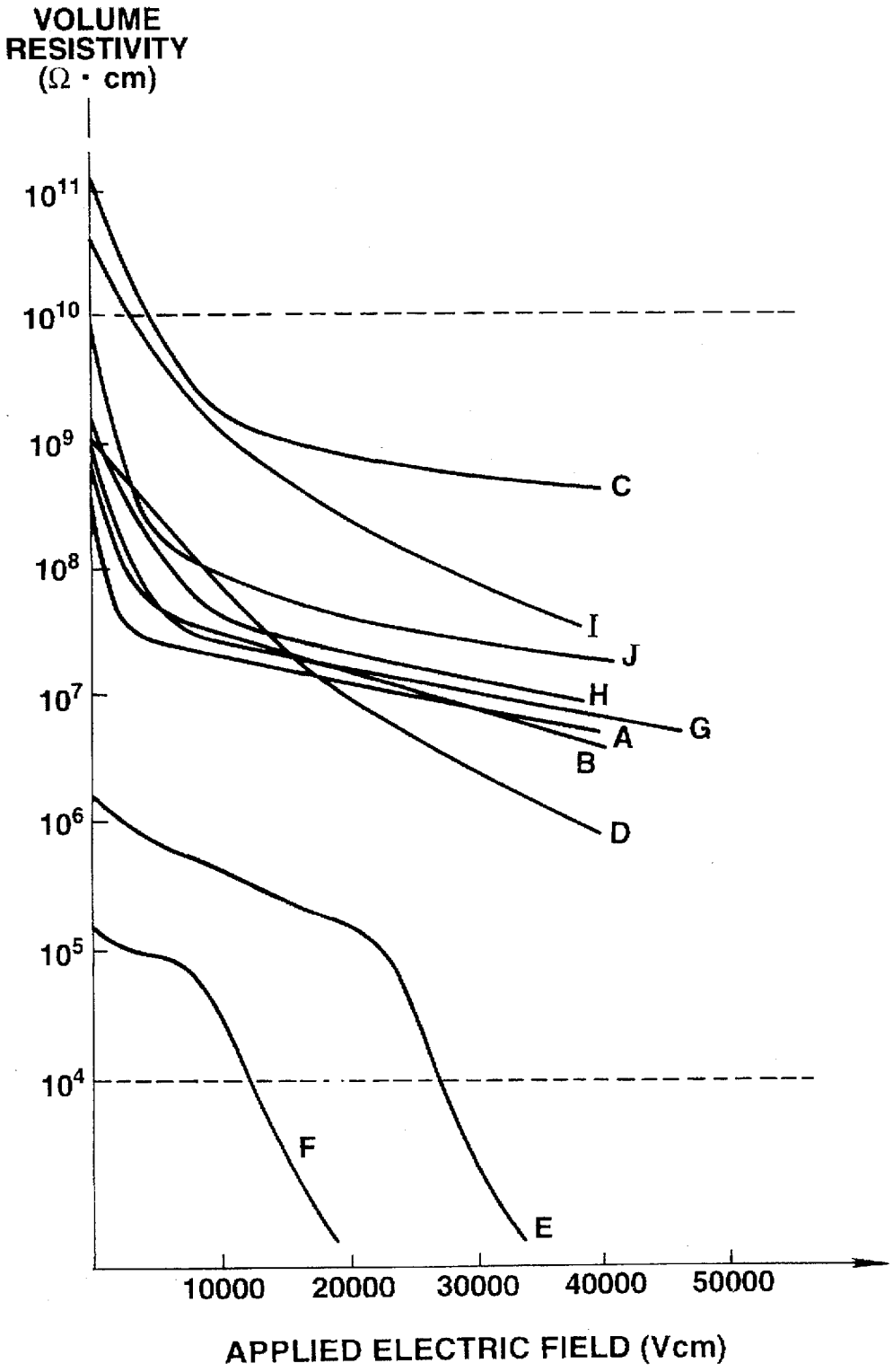
FIG. 4 is a graph illustrating the relationship between the volume resistivities of respective charging members and the applied electric field.

Zn—Cu ferrite having a composition represented by $(Fe_2O_3)_{2.3}(CuO)_1(ZnO)_1$ and having an average particle size of 25 μm and having a specific surface area of 0.12 $m^2/g$ was used for the magnetic particles. The dependency of the volume resistivity of a charging member comprising the magnetic particles on the applied electric field was measured in an environment of 23° C. and 65% relative humidity. The result is indicated by A in FIG. 4. The volume resistivity of the magnetic particles was measured using the above-described dynamic resistivity measuring apparatus using an aluminum drum.

EXAMPLE 12 OF MANUFACTURE OF CHARGING MEMBERS

By adding the magnetic particles of Example 11 of manufacture of charging members to a solution obtained by dissolving a silicone resin, in which carbon black was dispersed, at 1 weight part relative to 100 weight part of the magnetic particles in a toluene solvent, and stirring the resultant solution, a conductive-resin coating was formed on the surfaces of the magnetic particles. The solvent was removed by heating and drying while stirring the solution. The dependency of the resistivity of the obtained magnetic particles or, the applied electric field was measured according to the above-described method. The result is indicated by B in FIG. 4. The specific surface area of the magnetic particles was 0.10 $m^2/g$.

EXAMPLE 13 OF MANUFACTURE OF CHARGING MEMBERS

Oxidation processing was performed for the Zn-Cu ferrite of Example 11 of manufacture of charging members. The dependency of the resistivity of the obtained magnetic particles on the applied electric field was measured according to the above-described method. The result is indicated by C in FIG. 4. The specific surface area of the magnetic particles was 0.13 $m^2/g$.

EXAMPLE 14 or MANUFACTURE OF CHARGING MEMBERS

A conductive resin obtained by dispersing 3% of carbon black in a silicone resin was coated on the surfaces of the magnetic particles obtained by performing oxidation processing on the Zn-Cu ferrite of Example 11 of manufacture of charging members. The dependency of the resistivity of the obtained magnetic particles on the applied electric field was measured according to the above-described method. The result is indicated by D in FIG. 4. The specific surface area of the magnetic particles was 0.10 $m^2/g$.

EXAMPLE 15 OF MANUFACTURE OF CHARGING MEMBERS

A silicone resin was coated on the surfaces of magnetic particles, comprising Mn—Zn ferrite having a composition represented by $(Fe_2O_3)_{2.4}(MnO)_1(ZnO)_{1.1}$, having an average particle size of 45 μm. The dependency of the resistivity of the obtained magnetic particles on the applied electric field was measured according to the above-described method. The result is indicated by E in FIG. 4. The specific surface area of the magnetic particles was 0.09 $m^2/g$.

EXAMPLE 16 OF MANUFACTURE OF CHARGING MEMBERS

Mn-Zn ferrite having a composition represented by $(Fe_2O_3)_{2.4}(MnO)_1(ZnO)_{1.1}$, having an average particle size of 45 μm and having a specific surface area of 0.14 $m^2/g$ was used for the magnetic particles. The dependency of the resistivity of the magnetic particles on the applied electric field was measured according to the above-described method. The result is indicated by F in FIG. 4.

EXAMPLE 17 OF MANUFACTURE OF CHARGING MEMBERS

By adding the Zn-Cu ferrite of Example 11 of manufacture or charging members to a solution obtained by dissolving a titanate coupling agent KR TTS (made by Ajinomoto Co., Inc.) at 0.05 weight part relative to 100 weight part of the magnetic particles in a methyl-ethyl-ketone solvent, and stirring the resultant solution, an organic coating was formed on the surfaces of the magnetic particles. The solvent, was removed by heating and drying while stirring the solution. The average size of the obtained magnetic particles was measured and turned out to be substantially the same as that of the original magnetic particles. The dependency of the resistivity of the magnetic particles on the applied electric field was measured according to the above-described method. The result is indicated by G in FIG. 4. The specific surface area of the magnetic particles was 0.12 $m^2/g$.

EXAMPLE 18 OF MANUFACTURE OF CHARGING MEMBERS

By adding the Zn-Cu ferrite of Example 12 of manufacture of charging members to a solution obtained by dissolving a titanate coupling agent KR TTS (made by Ajinomoto Co., Inc.) at 0.05 weight part, relative to 100 weight part of the magnetic particles in a methyl-ethyl-ketone solvent, and by removing the solvent while stirring the resultant solution, an organic coating was formed on the surfaces of the magnetic particles. The average size of the obtained magnetic particles was measured and turned out to be substantially the same as that of the original magnetic particles. The dependency of the resistivity of the magnetic particles on the applied electric field was measured according to the above-described method. The result is indicated by B in FIG. 4. The specific surface area of the magnetic particles was 0.10 $m^2/g$.

EXAMPLE 19 OF MANUFACTURE OF CHARGING MEMBERS

By adding the Zn-Cu ferrite of Example 11 of manufacture of charging members to a solution obtained by dissolving a silicone resin, in which carbon black was dispersed, at 1 weight part and an aluminum compound containing fluorine-carbon chains FA-21 (made by Ajinomoto Co., Inc.) at 0.1 weight part relative to 100 weight part of the magnetic particles in a toluene solvent, and by stirring the resultant solution, a coating of a conductive resin containing the aluminum compound containing fluorine-carbon chains was formed on the surfaces of the magnetic particles. The solvent was removed by heating and drying while stirring the solution. The dependency of the resistivity of the obtained magnetic particles on the applied electric field was measured according to the above-described method. The result is indicated by H in FIG. 4. The specific surface area of the magnetic particles was 0.10 $m^2/g$.

EXAMPLE 20 OF MANUFACTURE OF CHARGING MEMBERS

A 15% N-methoxymethylated nylon (product name: Tresin made by Teikoku Kagaku Kabushiki Kaisha) solution dissolved in a mixed solvent of methyl ethyl ketone and methanol was coated on the surfaces of the Zn-Cu-ferrite magnetic particles of Example 11 of manufacture of charging members using a fluid-bed-type coater (Spirocoater made by Okada Seiko Kabushiki Kaisha). The dependency of the resistivity of the obtained magnetic particles on the applied electric field was measured according to the above-described method. The result is indicated by I in FIG. 4. The specific surface area of the magnetic particles was 0.12 $m^2/g$.

EXAMPLE 23 OF MANUFACTURE OF CHARGING MEMBERS

The same Zn-Cu ferrite as that of Example 11 of manufacture of charging members was used for the magnetic particles, except that the average size was 6 um. The dependency of the resistivity of the obtained magnetic particles on the applied electric field was measured according to the above-described method. The result is indicated by J in FIG. 4. The specific surface area of the magnetic particles was 0.77 $m^2/g$.

Embodiment 10

A description will now be provided of an electrophotographic printer used in the present embodiment with reference to FIG. 1. In FIG. 1, the process speed of the printer is 100 mm/sec. The photosensitive member manufactured in Example 4 of manufacture of photosensitive members is used as a photosensitive member 1. A charging member 2 comprises magnetic particles 2*a* manufactured in Example 11 of manufacture of charging members. There are also shown a conductive sleeve 3 made of aluminum, whose nonmagnetic surface is subjected to blast processing, for providing an ear of the magnetic particles 2*a* to be used as a magnetic brush, and a magnet roll 4 incorporated within the conductive sleeve 3. The gap between the magnetic-particle holding sleeve 3 and the photosensitive member 1 is about 500 μm. The magnetic particles 2*a* are coated on the sleeve 3 so as to form a charging nip having a width of about 5 mm with the photosensitive member 1. The magnet roll 4 is fixed, and the sleeve 3 is rotated at the same speed as the circumferential speed of the surface of the photosensitive member 1 in the reverse direction, so that the photosensitive member 1 and the magnetic brush 2*a* uniformly contact each other. When no difference is provided between the circumferential speeds of the magnetic brush 2*a* and the photosensitive member 1, since the magnetic brush 2*a* itself does not have a physical restoring force, it is often difficult to secure the nip of the magnetic brush 2*a* when the magnetic brush 2*a* is pushed back due to deflection, eccentricity or the like of the photosensitive member 1, thereby causing a failure in charging. Accordingly, since it is preferred to always provide a new surface of the magnetic brush 2*a*, in the present embodiment, charging is performed using the charging device rotating at the same speed as the photosensitive member 1, in a reverse direction.

Then, image exposure is performed by an exposure unit. In this process, an electrostatic latent image is formed by projecting laser light 5 from a laser diode, which is, for example, subjected to intensity modulation in accordance with an image signal, onto the photosensitive member 1 while performing scanning of the laser light 5 using a polygonal mirror.

Then, reversal development is performed using the toner manufactured according to the above-described example of manufacture of toners. The rotational circumferential speed of a stainless steel sleeve 6, serving as a toner carrying member, is arranged to be 180% of the rotational circumferential speed of the photosensitive member 1 in the same direction as the photosensitive member 1 at a contact portion between the stainless steel sleeve 6 and the photosensitive member.

In order to control the amount of the developer, a non-magnetic stainless steel blade is provided above the stainless steel sleeve 6 with a gap of 500 μm. A toner receptable is divided into two portions, and a member for stirring the developer and a member for detecting the toner/carrier ratio (toner density) of the developer are provided behind the sleeve 6. A portion behind the developer stirring member is used as a toner hopper and a member for supplying the toner in accordance with the detected toner-density signal is provided at a partition dividing the receptacle into two portions.

The electrophotographic apparatus was reformed and process conditions were set so as to meet the above-described image forming process. The transfer member was arranged to rotate following the photosensitive member.

The toner manufactured in the example of manufacture of toner was used for the developer, and a ferrite carrier and the toner were mixed at a ratio of 100:5. A voltage obtained by superimposing a DC voltage of −550 V on an AC voltage having a frequency of 3,000 Hz and a peak-to-peak voltage of 2,000 V was used, and contact two-component development was performed between the sleeve 6 and the photosensitive member 1.

An image developed by the toner was transferred onto a transfer material 8. A transfer roller 7 having a medium-range resistivity was used as transfer means. In the present embodiment,, the resistivity of the transfer roller 7 was $5\times10^8$ Ω.cm, and image transfer was performed by applying a DC voltage of +2500 V.

The toner image transferred to the transfer material 8 was then fixed by a thermal fixing roller 10, and the transfer material 8 having the fixed image was discharged from the apparatus. Untransferred toner particles were scraped off from the surface of the photosensitive member 1 by a cleaning blade 9 to be used for the next image formation.

The same evaluation as in Embodiment 1 (Evaluations 1 and 2) was performed using the printer having the above-described configuration. The measurement of the surface potential of the photosensitive member and the evaluation of the obtained image were performed for the following evaluation items in an environment of 23° C. and 65% relative humidity. The results are shown in Table 2.

Evaluation 4

A DC voltage of −700 V was applied to the charging member, and the rise of the surface potential of the photosensitive member initially at 0 V (the potential at the first revolution of the photosensitive member) was measured.

Evaluation 5

Images obtained when the applied voltage is −700 V were evaluated. Image evaluation was performed by printing a vertical A4-size image comprising an entirely-black image portion (corresponding to a low potential) for one revolution of the photosensitive member (about 94 mm in the present embodiment) followed by an entirely-white image portion (corresponding to a high potential), and by evaluating the charging ghost in the obtained image. If a failure in charging occurs, the potential does not sufficiently rise immediately after the entirely-black image portion, thereby producing a fog in reversal development. In this system, the surface potential on the photosensitive member when entering the charging member was about +1,000 V. That is, an electric field of 34,000 V/cm was applied to the charging member.

The degree of the fog was evaluated according to the following evaluation items. The fog was measured using a reflection-type densitometer (Reflectometer Model TC-6DS made by Tokyo Denshoku Co., Ltd. ). When the worst reflection density of a white portion after printing is represented by $D_s$, and the mean value of the reflection density of the sheet before printing is represented by $D_r$, the value $(D_s-D_r)$ is defined as the amount of the fog. In Table 2, A represents excellent (less than 3%), B represents the lower limit for practical use (3–5%), and C represents incapability of practical use because of the generation of a fogged image due to a failure in charging (exceeding 5%).

Evaluation 6

The flow of the image due to the flow of the potential in the lateral direction was evaluated using character images according to the following evaluation items (visual evaluation). In Table 2, A represents excellent (no generation of image flow), and C represents incapability of practical use (generation of image flow).

Evaluation 7

Image formation was performed on defective photosensitive members, each provided by peeling the photosensitive layer on the photosensitive member of Example 11 of manufacture of the photosensitive members by about 1 mm to expose the aluminum base layer, by applying a DC voltage of −1 kV, and the degree of failure in the obtained image due to a failure in charging caused by dielectric breakdown was evaluated according to the following evaluation items. In Table 2, A represents excellent (failure in the obtained image is present only in the defective portion of the photosensitive member), B represents the lower limit of practical use (failure in the obtained image is present within the range of about 30 mm from the defective portion on the photosensitive member), and C represents incapability of practical use (failure in the obtained image is present all over the image).

Evaluation 8

In order to evaluate accelerated durability 1 weight % of toner particles of the example of manufacture of toner was added to the charging member, and the resultant charging member was mounted in the charging unit and was subjected to idle rotation for 30 minutes. After the idle rotation, the photosensitive member formed according to the method of Example 1 of manufacture of photosensitive members was mounted. By applying a DC voltage while rotating the photosensitive member and the charging unit, the toner mixed in the carrier was transferred onto the photosensitive member to remove the toner in the carrier. Then, image formation was performed on the photosensitive member formed according to the method of Example 11 of manufacture of photosensitive members using the carrier after idle rotation after removing the toner, and evaluation was performed according to the same evaluation items as in Evaluation 5.

Embodiment 11

The same evaluation as in Embodiment 10 was performed, except that the magnetic particles of the charging member were replaced by the magnetic particles of Example 12 of manufacture of charging members.

Embodiment 12

The same evaluation as in Embodiment 10 was performed, except that the magnetic particles of the charging member were replaced by the magnetic particles of Example 14 of manufacture of charging members.

Embodiment 13

The same evaluation as in Embodiment 10 was performed, except that the photosensitive member was replaced by the photosensitive member of Example 5 of manufacture of photosensitive members.

Embodiment 14

The same evaluation as in Embodiment 10 was performed, except that the magnetic particles of the charging member were replaced by the magnetic particles of the charging member of Example 17 of manufacture of charging members.

Embodiment 15

The same evaluation as in Embodiment 10 was performed, except that the magnetic particles of the charging member were replaced by the magnetic particles of the charging member of Example 18 of manufacture of charging members.

Embodiment 16

The same evaluation as in Embodiment 10 was performed, except that the magnetic particles of the charging member were replaced by the magnetic particles of the charging member of Example 19 of manufacture of charging members.

Embodiment 17

A copier NP6060 made by Canon Inc. was prepared. Only the primary charging portion of the apparatus was reformed so that the following charging member was mounted. The photosensitive member of Example 7 of manufacture of photosensitive members was used. The magnetic particles of Example 11 of manufacture of charging members were used for the contact charging member. In order to hold the magnetic particles, a nonmagnetic conductive sleeve and a magnet roll incorporated therein were provided, and the magnetic particles were coated on the sleeve at a thickness of 1 mm so as to form a charging nip of about 8 mm with the photosensitive member. The gap between the sleeve for holding the magnetic particles and the photosensitive member was arranged to be about 500 μm. The magnet roll was fixed, and the sleeve was rotated so that the surface of the sleeve rotated at a speed twice the circumferential speed of the surface of the photosensitive member, in a reverse direction, and the apparatus was arranged so that the photosensitive member uniformly contacted the magnetic brush. The same evaluation as in Embodiment 1 was performed using this copier.

The DC voltage applied to the charging member in Evaluation 4 was changed to +450 V. As for image evaluation in Evaluation 5, entirely black images were evaluated because the above-described copier uses an ordinary developing method wherein failure in charging appears as white stripes or spots on an entirely black image. The following ratings were assigned: A: excellent (no generation of white stripes or spots); C: incapability of practical use (generation of white strips or spots on the obtained image due to a failure in charging). Since pre-exposure is performed before charging in order to remove surface charges on the photosensitive member, the maximum electric field applied to the charging member is determined by the voltage applied to the charging member. In this case, the value equals 9,000 V/cm. Evaluation 8 was also performed by applying a voltage of +450 V.

Embodiment 18

The same evaluation as in Embodiment 17 was performed, except that the magnetic particles of the charging member were replaced by the magnetic particles of Example 15 of manufacture of charging members.

Embodiment 19

The same evaluation as in Embodiment 17 was performed except, that the magnetic particles of the charging member were replaced by the magnetic particles of Example 16 of manufacture of charging members.

Comparative Embodiment 4

The same evaluation as in Embodiment 10 was performed, except that the photosensitive member was replaced by the photosensitive member of Example 6 of manufacture of photosensitive members.

Embodiment 20

The same evaluation as in Embodiment 10 was performed, except that the magnetic particles of the charging member were replaced by the magnetic particles of the charging member of Example 15 of manufacture of charging members.

Embodiment 21

The same evaluation as in Embodiment 10 was performed except that the magnetic particles of the charging member were replaced by the magnetic particles of the charging member of Example 13 of manufacture of charging members.

Comparative Embodiment 5

The same evaluation as in Embodiment 10 was performed, except that the magnetic particles of the charging member were replaced by the magnetic particles of the charging member of Example 20 of manufacture of charging members.

Comparative Embodiment 6

The same evaluation as in Embodiment 10 was performed, except that the magnetic particles of the charging member were replaced by the magnetic particles of the charging member of Example 21 of manufacture of charging members.

TABLE 2

| | Example of manufacture | | Evaluation items | | | | | | |
|---|---|---|---|---|---|---|---|---|---|
| | Charging member | Photosensitive member | 1 | 2 | 4 | 5 | 6 | 7 | 8 |
| Embodiment 10 | 11 | 4 | 2.2 | 40 | −680 | A | A | A | B |
| Embodiment 11 | 12 | 4 | 1.9 | 30 | −675 | A | A | A | A |
| Embodiment 12 | 14 | 4 | 1.9 | 30 | −670 | A | A | A | A |
| Embodiment 13 | 11 | 5 | 2.2 | 40 | −680 | A | A | A | B |
| Embodiment 14 | 17 | 4 | 1.8 | 30 | −675 | A | A | A | A |
| Embodiment 15 | 18 | 4 | 1.3 | 25 | −675 | A | A | A | A |
| Embodiment 16 | 19 | 4 | 1.0 | 10 | −670 | A | A | A | A |
| Embodiment 17 | 11 | 7 | 2.2 | 30 | +410 | A | A | A | B |
| Embodiment 18 | 15 | 7 | 1.8 | 35 | +425 | A | A | B | B |
| Embodiment 19 | 16 | 7 | 2.3 | 50 | +435 | A | A | B | B |
| Embodiment 20 | 15 | 4 | 1.8 | 35 | −685 | A | A | B | B |
| Embodiment 21 | 13 | 4 | 2.2 | 45 | −620 | B | A | A | B |
| Comparative Embodiment 4 | 11 | 6 | 2.2 | 40 | −680 | A | C | A | B |
| Comparative Embodiment 5 | 20 | 4 | 5.2 | 170 | −630 | B | A | A | B |
| Comparative Embodiment 6 | 21 | 4 | 4.1 | 90 | −695 | A | A | A | C |

While the present invention has been described with respect to what is presently considered to be the preferred embodiments, it is to be understood that the invention is not limited to the disclosed embodiments. The present invention is intended to cover various modifications and equivalent, arrangements included within the spirit and scope of the appended claims.

What is claimed is:

1. A charging apparatus, comprising:

an electrophotographic photosensitive member comprising a photosensitive layer provided on a conductive supporting member; and a charging member comprising magnetic particles, in contact with said electrophotographic photosensitive member, for charging said electrophotographic photosensitive member when a voltage is applied to said charging member, wherein a layer of said electrophotographic photosensitive member most separated from the conductive supporting member has a volume resistivity between $10^8$ Ω.cm and $10^{15}$ Ω.cm, and wherein the magnetic particles have a hygroscopic property such that a ratio H/L of a maximum value H to a minimum value L of an amount of water contained within the particles is at least 1 and less than 4.

2. A charging apparatus according to claim 1, wherein the ratio H/L is at least 1 and less than 2.4.

3. A charging apparatus according to claim 1, wherein the magnetic particles have a surface layer containing a compound having hydrophilic groups and hydrophobic groups.

4. A charging apparatus according to claim 3, wherein said compound comprises at least one compound selected from the group consisting of titanate coupling agents, aluminum coupling agents, and silane coupling agents.

5. A charging apparatus according to claim 1, wherein the magnetic particles have a volume resistivity between $10^4$Ω.cm and $10^9$ Ω.cm.

6. A charging apparatus according to claim 1, wherein the magnetic particles have an average particle size between 5 μm and 200 μm.

7. A charging apparatus according to claim 1, wherein the magnetic particles have a specific surface area less than or equal to 0.5 $m^2$/g.

8. A charging apparatus according to claim 1, wherein said charging member has a volume resistivity, measured by a dynamic resistivity measuring method, between $10^4$ Ω.cm and $10^{10}$ Ω.cm.

9. A charging apparatus according to claim 8, wherein said charging member has a resistivity characteristic such that a ratio $R_1/R_2$ of a maximum value $R_1$ to a minimum value $R_2$ of the volume resistivity is less than or equal to 1000.

10. A charging apparatus according to claim 1, wherein the layer of said electrophotographic photosensitive member most separated from the conductive supporting member contains conductive particles and a binding resin.

11. A charging apparatus according to claim 10, wherein the layer of said electrophotographic photosensitive member most separated from the conductive supporting member further contains lubricant particles.

12. An electrophotographic apparatus, comprising:

an electrophotographic photosensitive member comprising a photosensitive layer provided on a conductive supporting member;

a charging member comprising magnetic particles, in contact with said electrophotographic photosensitive member, for charging said electrophotographic photosensitive member when a voltage is applied to said charging member;

exposure means;

developing means; and transfer means, wherein a layer of said electrophotographic photosensitive member most separated from the conductive supporting member has a volume resistivity between $10^8$ Ω.cm and $10^{15}$ Ω.cm, and wherein the magnetic particles have a hygroscopic property such that a ratio H/L of a maximum value H to a minimum value L of an amount of water contained within the particles is at least 1 and less than 4.

13. An electrophotographic apparatus according to claim 12, wherein the ratio H/L is at least 1 and less than 2.4.

14. An electrophotographic apparatus according to claim 12, wherein the magnetic particles have a surface layer containing a compound having hydrophilic groups and hydrophobic groups.

15. An electrophotographic apparatus according to claim 14, wherein said compound comprises at least one compound selected from the group consisting of titanate coupling agents, aluminum coupling agents, and silane coupling agents.

16. An electrophotographic apparatus according to claim 12, wherein the magnetic particles have a volume resistivity between $10^4$ Ω.cm and $10^9$ Ω.cm.

17. An electrophotographic apparatus according to claim 12, wherein the magnetic particles have an average particle size between 5 μm and 200 μm.

18. An electrophotographic apparatus according to claim 12, wherein the magnetic particles have a specific surface area less than or equal to 0.5 $m^2$/g.

19. An electrophotographic apparatus according to claim 12, wherein said charging member has a volume resistivity, measured by a dynamic resistivity measuring method, between $10^4$ Ω.cm and $10^{10}$ Ω.cm.

20. An electrophotographic apparatus according to claim 19, wherein said charging member has a resistivity characteristic such that a ratio $R_1/R_2$ of a maximum value $R_1$ to a minimum value $R_2$ of the volume resistivity is less than or equal to 1000.

21. An electrophotographic apparatus according to claim 12, wherein the layer of said electrophotographic photosensitive member most separated from the conductive supporting member contains conductive particles and a binding resin.

22. An electrophotographic apparatus according to claim 21, wherein the layer of said electrophotographic photosensitive member most separated from the conductive supporting member further contains lubricant particles.

* * * * *

UNITED STATES PATENT AND TRADEMARK OFFICE

CERTIFICATE OF CORRECTION

PATENT NO. : 5,724,632

DATED : March 3, 1998

INVENTOR(S) : FUMIHIRO ARAHIRA, ET AL.

It is certified that error appears in the above-identified patent and that said Letters Patent is hereby corrected as shown below:

COLUMN 1:

Line 20, "of" should read --or--.

COLUMN 3:

Line 46, "member" should read --member,--.

COLUMN 8:

Line 1, "direct on" should read --direction--.

COLUMN 17:

Line 45, "Weight" should read --weight %--.

COLUMN 18:

Line 30, "or," should read --on--.

COLUMN 19:

Line 18, "solvent," should read --solvent--.

UNITED STATES PATENT AND TRADEMARK OFFICE

CERTIFICATE OF CORRECTION

PATENT NO. : 5,724,632

DATED : March 3, 1998

INVENTOR(S) : FUMIHIRO ARAHIRA, ET AL.

It is certified that error appears in the above-identified patent and that said Letters Patent is hereby corrected as shown below:

COLUMN 21:

Line 30, "embodiment,," should read --embodiment,--.

COLUMN 24:

Line 65, "equivalent," should read --equivalent--.

Signed and Sealed this

Fifteenth Day of September, 1998

*Attest:*

*Attesting Officer*

BRUCE LEHMAN

*Commissioner of Patents and Trademarks*